United States Patent [19]

Garzon

[11] 4,209,680

[45] Jun. 24, 1980

[54] HIGH SPEED ACTUATING MECHANISM

[75] Inventor: Ruben D. Garzon, Malvern, Pa.

[73] Assignee: Gould Inc., Rolling Meadows, Ill.

[21] Appl. No.: 919,290

[22] Filed: Jun. 26, 1978

[51] Int. Cl.[2] ..... H01H 33/82

[52] U.S. Cl. ..... 200/148 R; 200/81 R; 200/144B; 335/147

[58] Field of Search ..... 200/148 R, 148 A, 148 B, 200/148 C, 148 D, 148 E, 148 F, 148 G, 148 H, 148 J, 148 BV, 144 B; 335/147, 148, 149, 150, 277

[56] References Cited

U.S. PATENT DOCUMENTS

| | | | |
|---|---|---|---|
| 2,930,870 | 3/1960 | Baer | 335/147 |
| 3,792,217 | 2/1974 | McConnell | 200/148 B |
| 3,821,506 | 6/1974 | McConnell | 200/148 BV |

*Primary Examiner*—J. V. Truhe
*Assistant Examiner*—Morris Ginsburg
*Attorney, Agent, or Firm*—Ostrolenk, Faber, Gerb & Soffen

[57] ABSTRACT

A high speed actuating mechanism for operating the contacts of a circuit interrupter has an operating shaft connected to the contacts and to an operating piston. The operating piston has a short-circuited conductive ring or repulsion disc which is closely coupled to a lenz coil operator in one position of the actuating mechanism. The operating piston also has an enlarged diameter sealing protrusion which seals against an annular seal which is concentric with the lenz coil operator. Both the lenz coil and the sealing ring are spring-mounted to have several degrees of resiliency to enable proper relative location of the repulsion disc and the lenz coil and proper relative location of the annular seal and contact protrusion to control seal penetration and to enable compensation for contact erosion when butt-type contacts are used.

14 Claims, 2 Drawing Figures

HIGH SPEED ACTUATING MECHANISM

BACKGROUND OF THE PRESENT INVENTION

This invention relates to high-speed operating mechanisms for circuit interrupters, and more specifically relates to a novel high-speed actuating mechanism using a combined lenz coil operator and pneumatic operator which can be adapted to the operation of any desired type of circuit interrupter including vacuum interrupters, gas blast interrupters, gas puffer-type interrupters and the like.

An extremely fast operating mechanism is very desirable in many circuit breaker applications. The use of a high-speed operating mechanism reduces the total interrupting time for circuit breakers and thus can minimize the length of time that an electric arc burns across the contacts and thus reduces the amount of erosion experienced by the contacts. High-speed and highly controllable operating mechanisms are also very desirable when the opening of the contacts of an interrupter should be obtained at some well-controlled predetermined time prior to current zero as in a synchronous type of circuit breaker.

It is well known that a very fast initial response can be obtained from an operating mechanism using an electrodynamic drive system consisting of a lenz coil and a movable repulsion disc coupled to the lenz coil. The movable disc is usually fixed to or is an integral part of the movable contact. These systems, however, can provide high acceleration force only for a short time since, as the gap between the disc and coil increases, the net repulsive force decreases very rapidly. To overcome this deficency, it is possible to add a mechanical assist to the system so that the opening force can be applied over a longer time. For example, it is well known to couple a pneumatic system to an electrodynamically operated system for operating a circuit interrupter as is shown in U.S. Pat. No. 3,821,506, issued June 28, 1974, in the name of Lorne D. McConnell and assigned to the assignee of the present application.

In systems of this type, the contact itself is used as the pneumatic operating piston. This limits the pneumatic force available due to constraints imposed by the operating pressures and the contact cross-sectional area which defines the piston area. These limitations could be overcome by using a separate piston, housed in its own pressure chamber, but it then becomes very difficult to maintain proper dimensioning for appropriately locating the contact operating piston and to control seal penetration into the blast valve seal and to control the coupling between the repulsion disc and the lenz coil operator.

Moreover, in applications requiring compensation for contact erosion, as when the contacts are of the butt-type commonly used with vacuum interrupters, the placement of the separate piston in its own chamber presents complex mechanical problems.

BRIEF DESCRIPTION OF THE PRESENT INVENTION

In accordance with the present invention, a novel high-speed actuating mechanism is provided which is independent of the contact system and includes a lenz coil and repulsion disc combined with a pneumatic operating-type mechanism having an operating piston which is separate from and mounted independently of the movable contact of the interrupter. Both the lenz coil and the pneumatic operating mechanism annular seal are spring-mounted so that they generally float relative to the operating piston, thereby permitting the automatic adjustment of the correct location of the seal relative to the piston and the automatic location of the lenz coil operator relative to its repulsion disc. In this embodiment, the position and motion of the piston and repulsion coil is fixed so that the lenz coil and valve seat float to accommodate them. Clearly, the components could be reversed, and the piston and/or repulsion disc could float relative to a fixed position lenz coil and seal.

The present invention further provides a novel floating bumper arrangement designed to absorb a high level of energy in order to stop the operating mechanism in a relatively short distance.

By way of example, the novel bumper arrangement of the present invention has been able to stop a mass of about seven pounds moving at a final velocity of about 52 feet per second in a distance of about $\frac{5}{8}$ of an inch.

The novel mechanism of the invention can be a self-contained mechanism and has an operating shaft extending from the piston operator. The operating shaft can be connected to any desired type of interrupter including interrupters which may be of the two-pressure gas blast-type or of the vacuum interrupter-type or the like. In addition, the novel operating mechanism of the invention can be used to provide a relatively high operating force over a relatively long distance at high speed for any desired purpose.

DETAILED DESCRIPTION OF THE INVENTION

Figure 1:
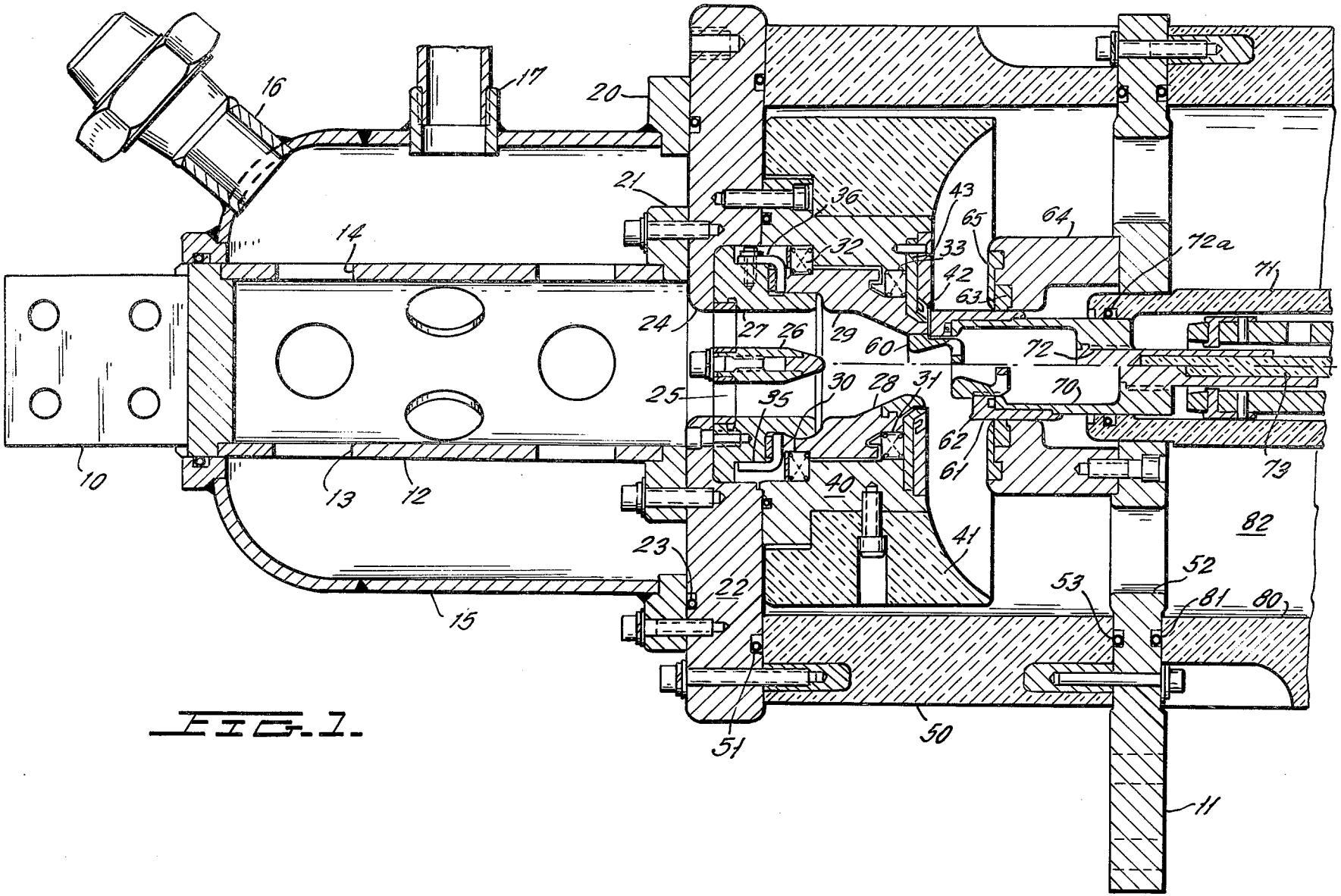
FIG. 1 is a cross-sectional view of the interrupter portion of one embodiment of the present invention wherein the mechanism above the center line is shown in the contact-closed position while the mechanism below the center line is shown in the contact-open position.
Figure 2:
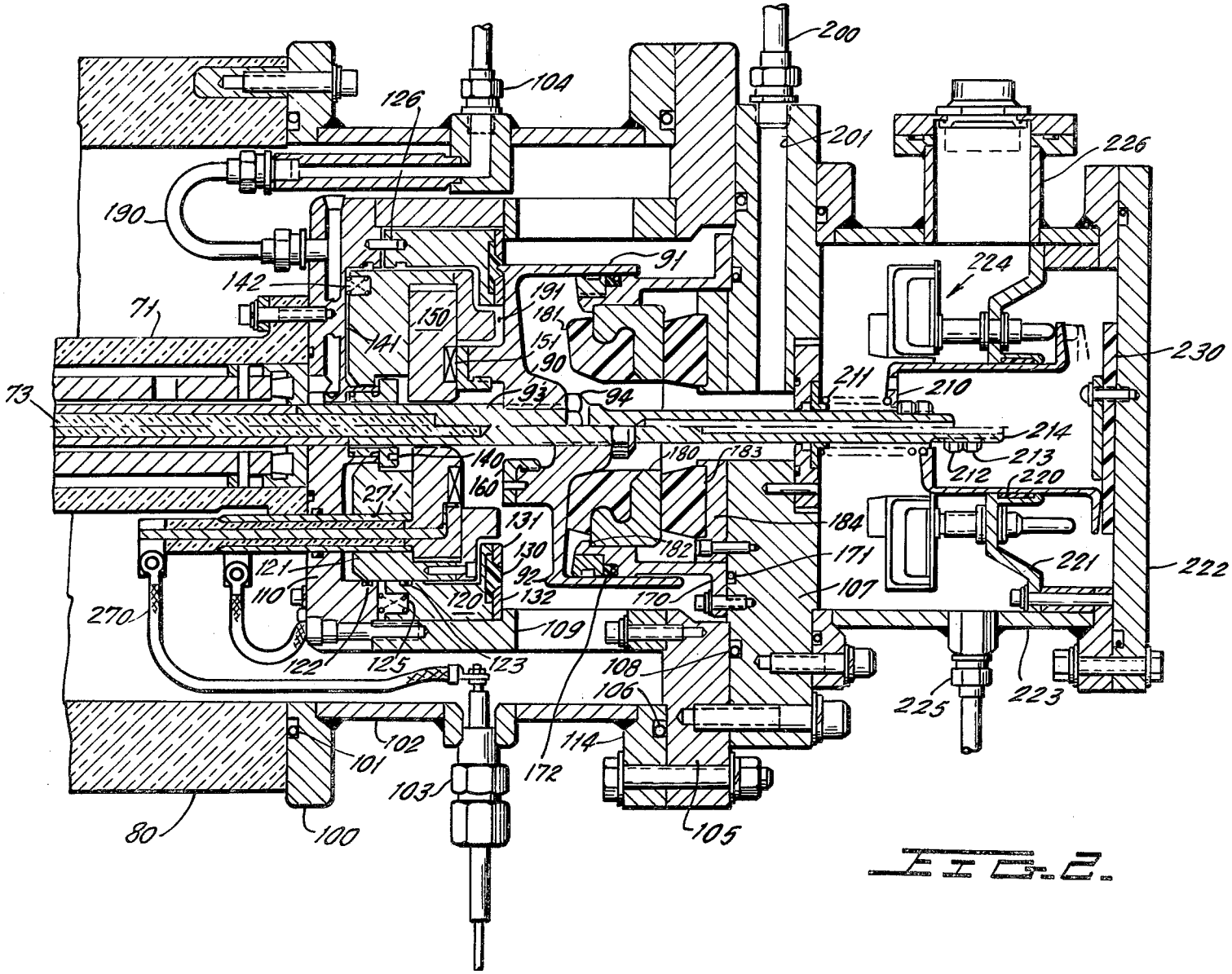
FIG. 2 is a continuation of FIG. 1 and shows the operating mechanism of the present invention for operating the circuit interrupter of FIG. 1, wherein the mechanism is shown in its closed position above the center line and in its open position below the center line corresponding to the contact closed and open positions respectively in FIG. 1.

In FIGS. 1 and 2, a single circuit interrupter and actuating mechanism are illustrated, but are shown in separate drawings for convenience. It will be noted, however, that FIGS. 1 and 2 are the continuous part of a single device.

The circuit interrupter chosen to illustrate the application of the invention is shown principally in FIG. 1 in the form of a two-pressure circuit interrupter. Note, however, that any desired type of circuit interrupter or other load could have been shown to cooperate with the novel operating mechanism of the invention which is shown principally in FIG. 2.

The specific circuit interrupter shown in FIG. 1 has main terminals 10 and 11 for the single pole shown. The first terminal 10 is connected to a conductive tube 12 which may be of copper and has openings such as openings 13 and 14 which communicate with the interior of the steel enclosure section 15. Enclosure 15 is filled with low-pressure gas, such as sulfur hexafluoride, at from 30 to 45 psi. Suitable fittings 16 and 17 are connected to member 15 to enable loading and evacuation of gas.

Member 15 is then fixed to a steel ring 20 as by welding, and the end of tube 12 is fixed to copper ring 21 in any desired manner. Rings 20 and 21 are then bolted to the aluminum ring 22 and a pressuretight fitting is formed by the sealing ring 23.

A central opening 24 in member 22 receives a spider 25 which carries a copper arcing contact 26. Opening 24 also receives ring 27 which may be of brass and which supports a plurality of contact fingers. Copper contact fingers 28 and 29 are shown in FIG. 1 and are two of a circular cluster of similar fingers. All contact fingers are spring-biased inwardly at their both ends by springs, such as springs 30, 31, 32 and 33 shown for contacts 28 and 29. A low-resistance electrical connection is made between the contact fingers 28 and 29 and the member 27 as by flexible conductors 35 and 36, respectively.

The contact fingers 28 and 29 are carried within an aluminum ring 40 which is fixed within an epoxy ring 41, as shown. An inflatable seal 42 is then held onto the ring 40 as by the brass plate 43 to serve as a valve seal in the manner disclosed in abovenoted U.S. Pat. No. 3,821,506.

The outer epoxy cylinder 50 is then fixed to the aluminum member 22 and sealed thereto by the sealing ring 51 and is fixed at its other end to an aluminum ring 52 which is continuous with the terminal 11. A sealing ring 53 ensures a good pressure seal between ring 52 and cylinder 50. The interior of cylinder 50 is filled by means of a conventional valve (not shown) with high-pressure sulfur hexafluoride which may be at a pressure of about 250 psi. This high pressure is normally isolated from the lowpressure region within member 15 by a seal which is formed to the inflatable seal 42 as shown above the center line in FIG. 1.

In FIG. 1, the movable contact is shown as an elongated cylindrical contact member 60 shown in the engaged position above the center line and the disengaged position below the center line. Contact 60 carries a sealing ring member 61 having an annular sealing projection 62 which engages the inflatable seal 42 when the contacts are engaged. Sealing member 61 is an integral part of the movable contact and makes sliding engagement with a conventional wiping contact ring 63 which is fixed in the copper ring 64 by the plate 65 which may be of brass. The copper ring 64 is then bolted to the aluminum ring 52 as shown.

The movable contact 60 is then fixed to aluminum shaft 70 which extends into an epoxy tube 71 and through a wiper seal 72*a*. Aluminum body 70 is fixed to aluminum tube 72 which is in turn connected to a glass filament operating rod 73 which is operated by the novel operating mechanism of the invention as will be disclosed in connection with FIG. 2.

As is shown in both FIGS. 1 and 2, the aluminum plate 52 has an epoxy cylinder 80 connected thereto and sealed thereto by the sealing ring 81 where the cylinder 80 encloses the high-pressure volume 82 along with the epoxy cylinder 50.

In the arrangement described to this point in FIG. 1, a current path can be traced through the system between terminals 10 and 11 and through the closed contacts (above the center line) in the circuit which includes contact 10, tube 12, ring 21, member 22, conductors 35 and 36 and the other conductors associated with the the other contact fingers, the contact fingers such as contact fingers 28 and 29, movable contact 60, contact ring 63, copper member 64 and then the aluminum ring 52 which is connected to the terminal 11. So long as the contact 60 is closed, the sealing bead 62 of the movable contact seals against the inflated rubber ring 42 and thus all high pressure within the breaker is confined to volume 82 and to the right of the sealing bead 62.

When the contacts are opened by the movement of the operating shaft 73 to the right in FIG. 1, the contacts are physically separated and the movable contact 60 moves to the position shown beneath the center line in FIG. 1. At the same time, the pressure seal at seal 42 is broken and high-pressure gas from volume 82 can flow between movable contact 60 and the contact fingers such as contact fingers 28 and 29, thereby to cool and deionize the arc which is subsequently transferred to the arcing contact 26 and extinguished by the cooling of the sulfur hexafluoride gas. This gas then flows into the low-pressure region within member 15 and may be exhausted to the external atmosphere through appropriate filters in the member 15.

Referring next to FIG. 2, there is shown therein the novel operating mechanism of the present invention which can be used for the operation of the interrupter of FIG. 1. The novel mechanism of the invention includes an operating piston 90 which has a cylindrical outer body 91 and a sealing protrusion 92. The interior diameter of member 90 is fixed to an aluminum sleeve 93 which is appropriately fixed to the glass filament rod 73. A nut 94 may be threaded onto aluminum member 93 to secure member 90 in position.

In accordance with the present invention, the operating piston 90 is separate from the contact 60 of the interrupter of FIG. 1 and is contained in its own housing arrangement and will be operated both by a lenz coil actuator and pneumatic operating system as will be described.

The operating mechanism portion of the structure includes an outer housing portion which includes a steel ring 100 which is sealed against cylinder 80 by the sealing ring 101 and a steel tube section 102 which receives an electrical fitting 103 and a gas fitting 104. Electrical fitting 103 receives the electrical operating energy for the lenz coil as will be described, and fitting 104 which permits low-pressure draining as will be described.

Tube 102 is connected to a stainless steel ring 114 which is bolted to an aluminum plate 105 with a pressure seal 106 compressed between members 114 and 105. Plate 105 is bolted to a further aluminum plate 107 and is sealed thereto by the seal 108.

A slotted aluminum support cylinder 109 is then bolted to member 105 and is supported thereby and carries an aluminum plate 110. The slotted cylinder 109 receives an annular ring 120 which may be of stainless steel and which is loosely fitted between the cylinder 109 and an internal ring 121 which is also of stainless steel. Pressure rings 122 and 123 are formed between an internal shoulder in the ring 110 and the interior of ring 120 and the outer periphery of member 121. The loosely mounted annular member 120 is then springsupported with respect to the fixed support 109 as by springs 125. Thus, member 120 is capable of axial movement relative to support 109 with this movement being guided as by guide pins located around the periphery of the member 120, such as the guide pin 126.

The right-hand surface of the floating or spring-mounted member 120 receives a rubber sealing ring 130 which is sealed between two brass rings 131 and 132 which are bolted to the right-hand surface of member 120. Ring 121 is fixed relative to the stationary support members 109 and 110 but is free to move axially with respect thereto. Thus, the member 110 has a projecting latching member 140 which limits the righthand maximum location of the steel ring 121 while the ring is free to move to the left to the internal surface 141 of member 110. A plurality of springs such as spring 142 are fixed between the member 121 and the member 110 so that the member 121 essentially floats with respect to member 110.

The member 121 then has fixed thereto an inpulse coil support disc 150 which carries an impulse coil 151 which may be of any desired type and defines a lenz coil type of operator. Note that the lenz coil 151 generally floats due to the spring-mounting as by springs 142 of the main support member 121. Similarly, it should be noted that the valve seal 130 generally floats by virtue of the spring-mounting of the member 120.

The piston 90 which is the main contact operating piston has a short-circuited aluminum ring 160 fixed thereto which serves as the repulsion coil which cooperates with the lenz coil 151. Because of the generally floating configuration of the lenz coil 151 and of the valve seal 130, the sealing bead 92 of the piston operator 91 and the short-circuited ring 160 of the lenz coil operator can seat in suitable positions relative to the valve seal 130 and the lenz coil 151, respectively, when the contact is closed and the operating mechanism is in the position shown above the center line in FIG. 2.

Electrical connection is made to the lenz coil 151 through the connection 103 and includes a conductor 270 of a coaxial system which passes through opening 271 in the member 121 and is then electrically connected to the coil in the manner generally described in U.S. Pat. No. 3,792,217, in the names of Lorne D. McConnell and Ralph Mockli, dated Feb. 12, 1974 and assigned to the assignee of the present invention.

The novel invention also provides a novel buffer system for bringing the operating mechanism to a quick stop after it has reached extremely high speeds at the end of of a relatively long stroke.

The buffer or damper system of the invention is supported from the plate 107 and includes a cylindrical steel bracket 170 which is sealed to the plate 107 as by the seal ring 171. The outer diameter of member 170 contains a wiper seal 172 which slidably receives the interior diameter of cylindrical extension 91 of piston 90.

The interior diameter of member 170 slidably supports a steel ring 180 which has a relatively large mass. Steel ring 180 carries a rubber ring 181 which is dimensioned to fit and receive the right-hand facing surface of piston 90. The steel ring 180 is axially movable to the right and away from the shoulder 182 and is movable into a further rubber shock-absorbing ring 183 which is fixed to the aluminum plate 184 which is bolted to member 107.

The operation of the operating mechanism of FIG. 2 can be now described. Assume first that the operating mechanism is in the closed position shown above the center line in FIG. 2. In this position, the repulsion disc 160 is coupled very closely to the lenz coil 151 with the lenz coil 151 moving slightly as necessary in order to accommodate the disc 160 in surface-to-surface contact. Similarly, the protrusion 92 of the piston 90 securely seals against the seal 130 with the seal penetration being controlled and limited by the point at which the left-hand surface of the operating piston 90 engages the brass plate member 131. Again this accommodation is obtained by the springmounting of the member 120 which carries the seal 130.

In order to operate the operating mechanism, a capacitor bank is discharged into the lenz coil 151 through the coaxial connection conductors including conductor 270 connected to the external connector 103. An extremely high repulsion force is created between the lenz coil 151 and the repulsion disc 160. When the repulsion disc 160 begins to move, piston 90 also moves to the right, and the seal to seal 130 is opened. Relatively high-pressure gas on the outside of piston 90 is applied to low-pressure volume 191. The initial low pressure in volume 191 is created through conduit 190 which is to the left of piston 90 in order to apply a high pneumatic force to the piston 90. Note that this pneumatic force will be present even after the repulsion force between the lenz coil 151 and repulsion disc 160 has decreased due to the separation between these members.

Thus, there is an extremely high speed and continuous motion of the piston 90 to the right and to the position shown below the center line in FIG. 2, thereby to move the operating rod 73 to the right and thus open the circuit interrupter to which the contact rod 73 is connected. Once the piston 90 reaches its righthand position, it engages the shock absorber assembly which is composed of rubber discs 181 and 183. The total mass of these members including the mass of steel member 180 is approximately equal to the moving mass of the moving mechanism and therefore, upon impact, a large portion of the kinetic energy of the moving parts is transferred to the shock absorber. The remaining energy is absorbed by the compression or distortion of the two rubber bodies that are connected in series. Possible rebound of the mechanism is prevented by the high pressure which is applied against the left-hand face of the piston 90.

In order to reclose the mechanism, a conduit 200 is provided which is connected to a channel 201 in the member 107 and which channel is in communication with the sealed right-hand surface of piston 90. Thus, in order to reclose, pressure is applied to conduit 200 to apply a force to the piston 90 which moves it to the left and to the closed and sealed position. Note that, when the piston 90 reaches its closed position, the lenz coil 151 will automatically align in closest possible proximity to the repulsion disc 160 and the bead 92 will seal with appropriate seal penetration into the seal 130.

In the device of FIG. 2, the aluminum member 93 continues to the right and terminates on an aluminum cup 210 which is biased toward the right by the spring 211. Nuts 212 and 213 on extending portion 214 of member 93 engage the interior of cup 210 to press cup 210 to the right when the operating mechanism is closed.

Cup member 210 is supported for easy sliding motion by the teflon ring 220 which is carried by aluminum support disc 221 which is, in turn, fixed to the aluminum end plate 222. A steel cylinder 223 is fixed between aluminum plate 222 and aluminum plate 107 and forms a pressure-tight connection between the two. The cup member 210 may then be used to operate a position indicator or suitable microswitch or other mechanism 224 as desired. Suitable pressure fittings 225 and 226 are connected to the cylinder 223.

A rubber shock absorber 230 is bolted to the plate 222 in order to absorb the shock of opening of the cup member 210 when it reaches its right-hand most position during the opening of the operating mechanism.

Cup 210 is not attached to the rod 93 and is free to move towards the right at a much slower velocity than the rod 93 is moving. This feature is added to prevent over accelerating the micro-switches 224 which are used as auxiliary contacts to identify the position of the mechanism. An additional feature of this mechanism is that in the present application it does not have any dynamic seal to atmosphere, thus constituting a completely closed system.

Although a preferred embodiment of this invention has been described, many variations and modifications will now be apparent to those skilled in the art, and it is preferred therefore that the instant invention be limited not by the specific disclosure herein but only by the appended claims.

What is claimed is:

1. A high-speed operating mechanism for a circuit interrupter of the type comprising relatively movable and relatively stationary contacts, said operating mechanism comprising, in combination: a circular operating piston having an operating shaft extending therefrom for connection to said movable contact of said interrupter; said piston having first and second opposing surfaces; an electrodynamic operator comprising a fixed lenz coil and a cooperating repulsion coil; said repulsion coil being fixed to said first surface of said piston; said piston having an annular sealing bead extending from its said first surface; means for confining a gas at a relatively high pressure in a first region; means cooperating with said first surface of said piston to define a region adjacent said first surface containing said gas at a relatively low pressure; an annular seal cooperating with said annular sealing bead and for sealing said relatively high-pressure gas which surrounds said piston from said relatively low-pressure region which is formed with said first surface when said annular sealing bead seals against said annular seal; first mounting means for relatively flexibly mounting said lenz coil to permit said lenz coil to couple closely to said repulsion coil by accommodating itself to the position of said repulsion coil, and second mounting means for flexibly mounting said annular seal relative to said piston to permit said annular seal to accommodate itself to the position of said sealing bead on said piston.

2. The combination of claim 1 wherein said movable contact is separate from said piston and is connected to said operating shaft.

3. The combination of claim 1 wherein said operating piston, said lenz coil, said repulsion coil, said operating shaft and said annular seal are all coaxial with one another.

4. The combination of claim 2 wherein said operating piston, said lenz coil, said repulsion coil, said operating shaft and said annular seal are coaxial with one another.

5. The combination of claim 1 which further includes means to increase the pressure against said first surface of said piston simultaneously with the energization of said lenz coil.

6. The combination of claim 1, 2, 3, or 4 which further includes shock absorber means disposed in a fixed position facing said second surface of said piston.

7. The combination of claim 6 wherein said shock absorber means includes a movable mass and first and second rubber bumpers which are serially connected to said position when said piston is operated by said lenz coil.

8. The combination of claim 2 wherein said interrupter is a gas blast-type interrupter.

9. The combination of claim 1 wherein said lenz coil and said annular seal are fixed to support ring masses; each of said support ring masses being spring-mounted on a fixed support structure.

10. An electrodynamic operating mechanism comprising an annular lenz coil, a movable repulsion coil movable responsive to a high-current surge in said lenz coil from a closely coupled position relative to said lenz coil to a remote position therefrom; said lenz coil and said repulsion coil being coaxial and said repulsion coil being movable along its own axis; a stationary mounting support means for said lenz coil; flexible mounting means for mounting said lenz coil on said stationary mounting support means, whereby said lenz coil has the ability to adapt itself to being seated on said repulsion coil when said repulsion coil is closely coupled thereto; and an operating shaft fixed to said repulsion coil and being operated thereby.

11. The mechanism of claim 10 wherein said repulsion coil consists of a ring of conductive material.

12. The mechanism of claim 10 which further includes a pneumatic piston and pneumatic operating mechanism therefor for operating said piston; said piston being fixed to said operating shaft.

13. The mechanism of claim 12 wherein said repulsion coil is fixed to said piston.

14. The mechanism of claim 10, 12 and 13 in combination with a circuit interrupter having a movable contact; said movable contact being connected to said operating shaft.

* * * * *